United States Patent [19]

Fleenor et al.

[11] 4,398,872

[45] Aug. 16, 1983

[54] AUXILIARY POWERED DRIVE FOR ROLLER PUMP USED IN CARDIOPULMONARY BYPASS OPERATIONS

[75] Inventors: Jonathan T. Fleenor; George W. Long, Jr.; John M. Dawson, all of Kansas City, Mo.

[73] Assignee: Trinity Lutheran Hospital, Kansas City, Mo.

[21] Appl. No.: 160,965

[22] Filed: Jun. 19, 1980

[51] Int. Cl.[3] ..... F04B 39/14; F04B 43/12

[52] U.S. Cl. ..... 417/360; 417/374; 417/477; 604/151

[58] Field of Search ..... 417/374, 477, 360; 128/214 F; 310/112

[56] References Cited

U.S. PATENT DOCUMENTS

| | | | |
|---|---|---|---|
| 1,934,155 | 11/1933 | Van Deventen | 417/360 |
| 3,038,411 | 6/1962 | Henschuch | 417/360 |
| 3,199,745 | 8/1965 | Hollis et al. | 417/360 X |
| 3,324,798 | 6/1967 | Freed | 417/360 X |
| 3,700,361 | 10/1972 | De Vries | 417/477 |
| 4,116,583 | 9/1978 | Brodis | 417/360 |
| 4,185,948 | 1/1980 | Maguire | 417/477 |

FOREIGN PATENT DOCUMENTS

| | | | |
|---|---|---|---|
| 628893 | 10/1961 | Canada | 417/360 |

*Primary Examiner*—Richard E. Gluck

*Attorney, Agent, or Firm*—Schmidt, Johnson, Hovey & Williams

[57] ABSTRACT

A powered unit is disclosed for providing an auxiliary drive for roller pumps of the type used in cardiopulmonary bypass operations in case the primary drive system for the pump fails or is rendered inoperative for any reason. The unit is provided with a base assembly supporting an electric motor oriented with the drive shaft aligned for coupling to an adapter designed to complementarily fit over or be operably joined to the pump rotor for direct drive thereof at a selected constant angular speed. Handle structure on the base unit is strategically located to allow medical personnel operating the heart-lung perfusion console to emplace the auxiliary drive unit in position and to activate operation of the same in a time period of no more than ten to fifteen seconds.

3 Claims, 8 Drawing Figures

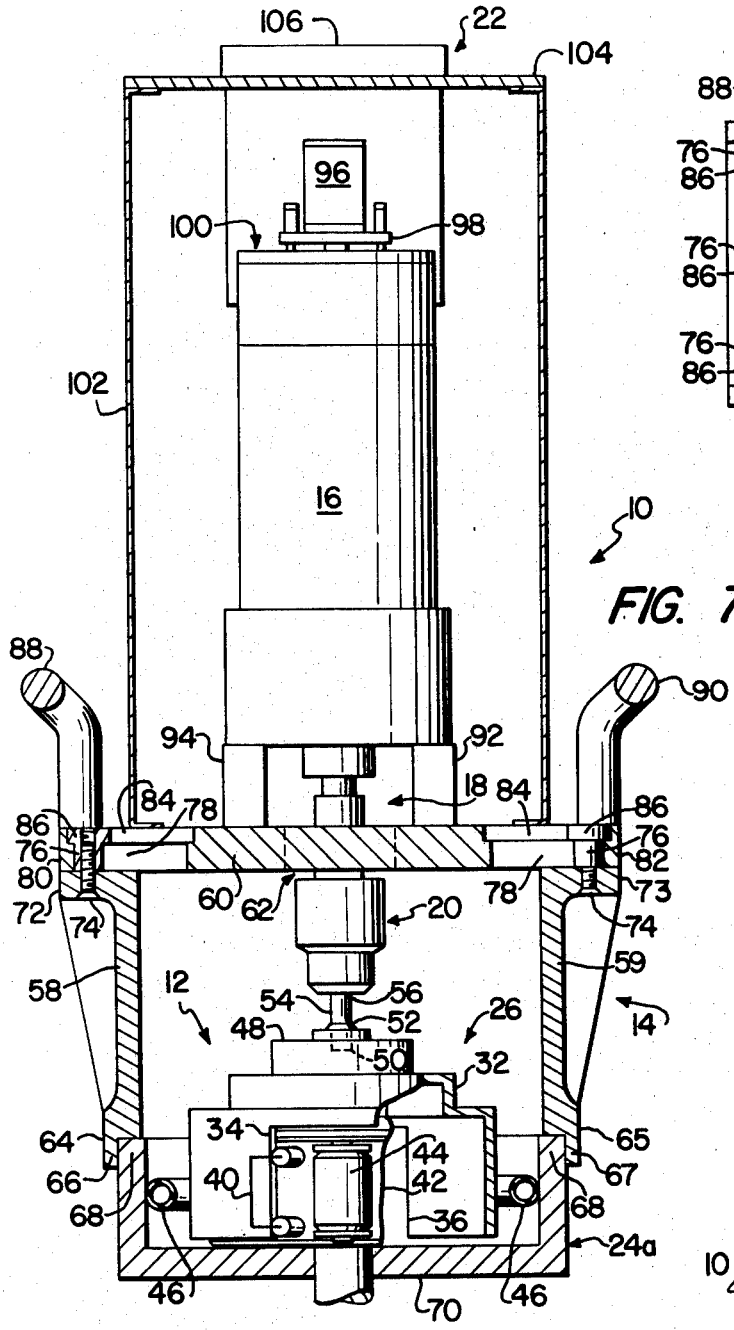
FIG. 7
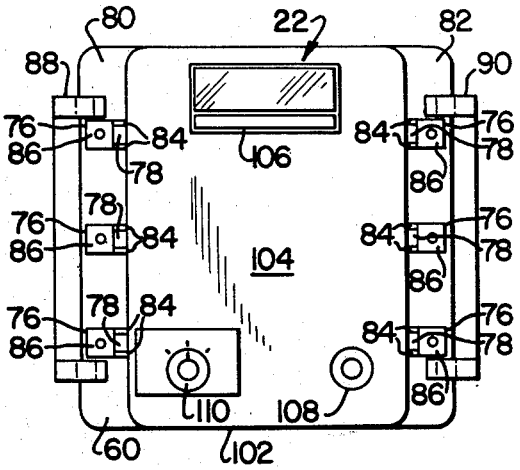
FIG. 6
FIG. 5
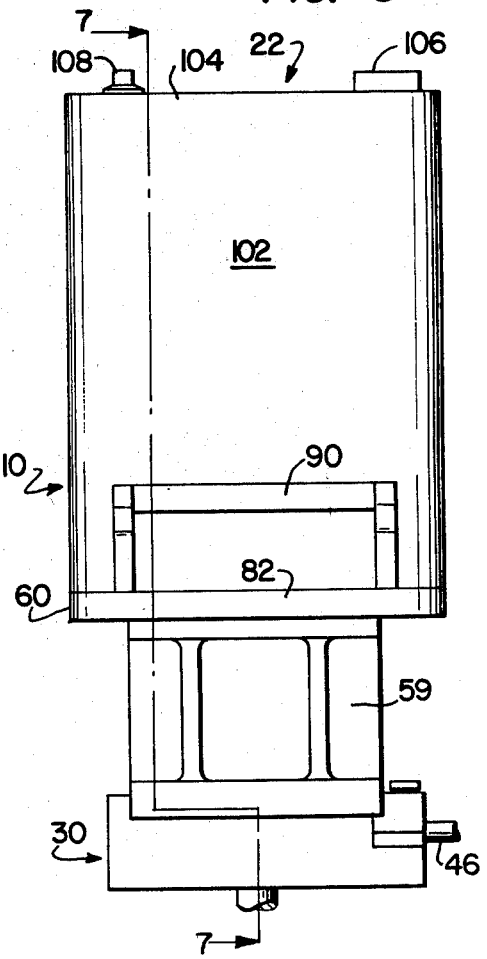
FIG. 8
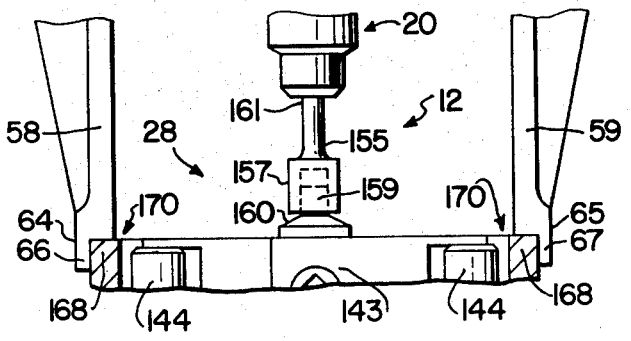

AUXILIARY POWERED DRIVE FOR ROLLER PUMP USED IN CARDIOPULMONARY BYPASS OPERATIONS

BACKGROUND OF THE INVENTION

The present invention pertains to drive systems for roller pumps used by surgeons in cardiopulmonary bypass operations to perfuse a patient's body with blood passed by means of tubing through an oxygenator for removal of carbon dioxide and addition of oxygen to the blood so that the patient's lungs and heart may be immobilized for surgical procedures. More specifically, this invention relates to a portable auxiliary drive system for such a pump for use in the event of a sudden failure of the normal roller pump drive. The novel drive system includes an adapter unit for quickly engaging the failed pump's rotor, a base unit carrying the drive motor which is placed directly on the failed pump, a connecting unit for connecting the drive motor to the adapter, and a regulation unit for controlling the motor speed.

PRIOR ART

Prior to this invention, if a perfusing roller pump failed during surgery, the attending technician had to quickly install a hand-crank and then manually rotate the pump rotor to maintain oxygenation of the blood and adequate perfusion of the patient's body until the patient's own heart and lungs were restarted. To maintain adequate perfusion, the rotor must turn at a speed within a critical range of revolutions per minute. This requirement combined with the considerable effort required to crank the rotor made manual perfusion so arduous a task that a prolonged period of manual perfusion posed a threat to the patient's survivial.

SUMMARY OF THE INVENTION

The problems outlined above are in large measure solved by the auxiliary drive system in accordance with the present invention. That is to say, the auxiliary drive system hereof provides a powered, portable auxiliary drive specially designed to facilitate quick engagement with a variety of roller pumps currently available and to allow precise regulation of the rotational speed of the motor during pump operation.

The drive system in accordance with this invention broadly includes an adapter for engaging the rotor of any of a variety of currently available roller pumps, a base unit adjustably configured for rapid placement on a failed roller pump head directly over the rotor, a motor and drive shaft carried by the base unit for driving the adapter in engagment with the rotor, a connecting unit for operationally joining the drive shaft and adapter, and a regulation unit for adjusting the speed of rotation of the rotor by regulating motor speed.

In preferred forms, the base unit consists of two planar members supporting a centrally perforated platform on which the motor is located and enclosed in a housing. The planar members engage the roller pump head and support the entire drive system. The drive shaft of the motor extends through the central perforation of the platform and by means of a chuck engages the adapter-rotor complex. The motor regulation unit is mounted on the housing in an easily accessible location. This arrangement, in cooperation with the rotor adapter, by locating the drive elements in one unit allows immediate re-start of the pump following placement of the unit on the failed pump head serving to reduce the time the patient must withstand loss of perfusion.

BRIEF DESCRIPTION OF THE DRAWINGS

FIG. 5 is a side elevation of the invention illustrating the base unit, handles, and motor housing;

FIG. 6 is a top view illustrating the tachometer display, motor speed control, and motor direction control;

FIG. 7 is a vertical sectional view taken along line 7—7 in FIG. 5 illustrating the motor, base unit, chuck, and adapter operationally engaged with a failed roller pump; and FIG. 8 is a detailed view illustrating the engagement of a second type of adapter with another type of roller pump rotor.

DESCRIPTION OF THE PREFERRED EMBODIMENT

Figure 1:
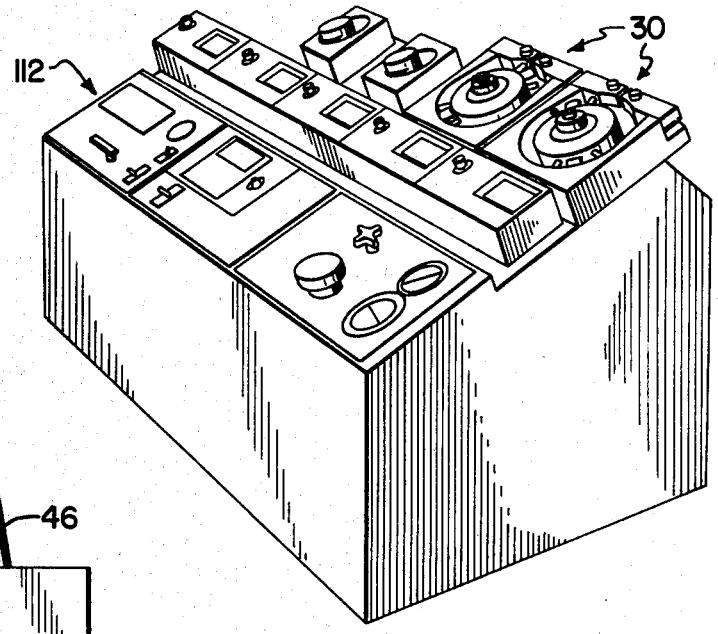
FIG. 1 is a perspective view of a standard heart-lung console illustrating the location of the modular roller pumps with respect to the pump control units in console housing.
Figure 2:
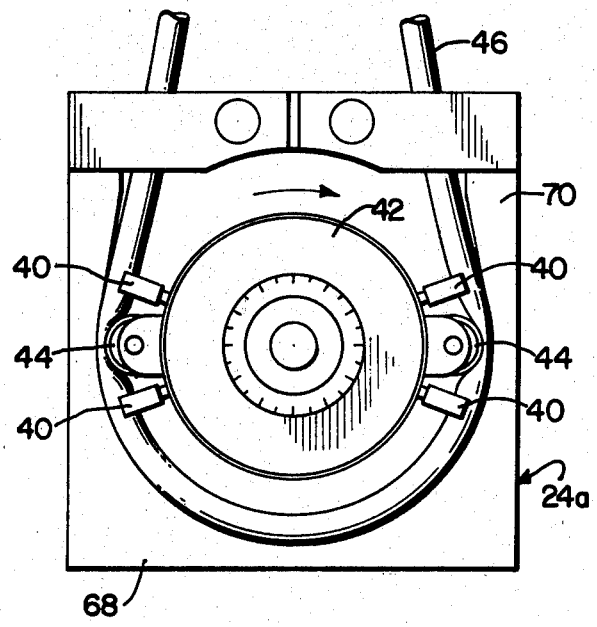
FIG. 2 is a top view of a roller pump head illustrating the operational occlusion of perfusion tubing by the tubing rollers of the pump rotor during a pumping operation.
Figure 3:
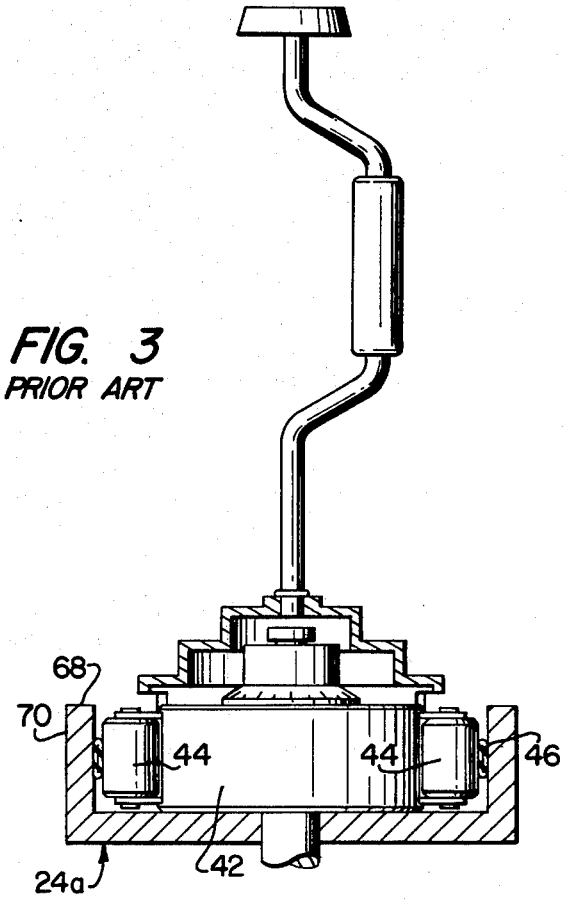
FIG. 3 PRIOR ART
FIG. 3 is a vertical sectional view of a roller pump head illustrating the engagement of one type prior art hand-crank with the pump rotor.
Figure 4:
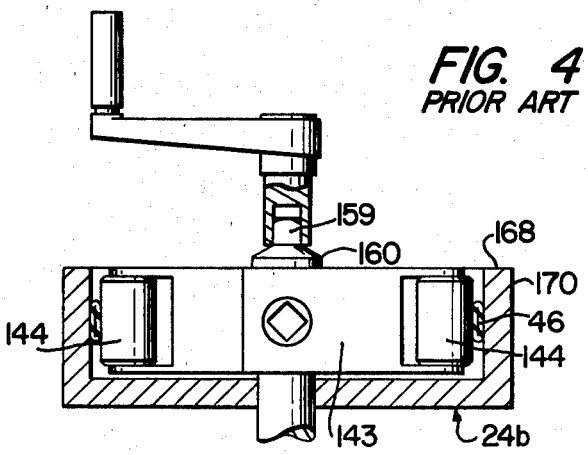
FIG. 4 PRIOR ART
FIG. 4 is a vertical sectional view of a roller pump head illustrating another type of prior art hand-crank in engagement with a pump rotor.

Referring now to the drawings, an auxiliary pump drive system 10 in accordance with the invention consists of an adapter broadly designated 12, a base unit 14, a motor 16 carried by the base unit 14 and provided with a drive shaft 18, an adjustable Jacobs-type chuck 20 for joining the drive shaft 18 and adapter 12 during operation, and a regulation unit 22 for controlling the speed of rotation of a modular roller pump 30. The base unit 14 is configured to facilitate quick, positive location of drive system 10 on a failed modular rolled pump 30 minimizing the time between pump drive failure and resumption of perfusion by means of drive system 10 to between ten and fifteen seconds.

Drive system 10 is specially designed to operate with any of the many modular roller pumps 30 now in use through the utilization of one of the several specific forms of adapter 12. In more detail, adapter 12 can take any one of several specific forms, one embodiment thereof being designated by the numeral 26 in FIG. 7 while another is delineated 28 in FIG. 8. The special adapter 26 is particularly suited for **24*a*, one roller pump in commercial use while adapter 28 is specifically designed to be employed with a second commercially used pump 24*b***.

In the embodiment 26 of adapter 12, a cup-like structure 32 (similar to an American Optical pump adapter) of internal diameter slightly greater than the external diameter of rotor 42 of roller pump **24*a* is provided which is inverted in use and has two notches 34,36 cut into its sidewall 38 so that sidewall 38 abuts the conventional tubing guide pins 40 of rotor 42 of roller pump 24*a* for driving engagement thereof when cup-like structure 32 is placed on rotor 42. The arrangement of the notches 34,36 for engagement of the tubing guide pins 40 which bracket the occlusion rollers 44 of the rotor 42 allows driving of the rotor 42 without encumbering the occlusion rollers 44 of the rotor 42 or the perfusion tubing 46. The normally upper surface 48 of the cup-like structure 32 is provided with a central socket 50 therein. This socket 50 removably receives a complemental end 52 of an elongated drive connector 54. The opposite end 56 of the drive connector 54 is removably received by chuck 20 for operatively joining drive shaft 18 to adapter 12 during operation of drive system 10. Rotation of connector 54, coupled to cup-like structure 32 engaging rotor 42, by motor 16 causes rotor 42 to rotate, moving occlusion rollers 44 along perfusion tubing 46**.

The base unit 14 consists of two normally vertically disposed, generally planar mounting rails 58,59 supporting a horizontal rectangular mounting plate 60 having a central perforation 62. The lower end 64,65 of the mounting rails 58,59 forms a flanged edge 66,67 which engages the upper opposed edges 68 of a roller pump head 70 for mounting the base unit 14 on the pump head 70 in predetermined, fixed disposition. The upper end 72,73 of the mounting rails 58,59 is secured to mounting plate 60 to allow limited transverse movement of the mounting rails 58,59 in sliding disposition with mounting plate 60 by means of screws 74 and associated tee nuts 76 seated in horizontally-opposed, parallel slots 78 extending inwardly from each of two opposite edges 80,82 of the mounting plate 60. Slots 78 are configured to engage and support the rectangular planar heads 86 of tee nuts 76 on longitudinally-extending inner ledges 84 of slots 78. The tee nuts 76, after being loosened, may slide in slots 78, ledges 84 of slots 78 supporting the planar heads 86 of tee nuts 76, permitting, as can readily be ascertained, inward-outward movement of mounting rails 58,59 relative to mounting plate 60. This feature allows quick adjustment of the drive system 10 to fit a variety of different sizes and commercial forms of pump heads 70. Handles 88,90 attached to two edges 80,82 of the mounting plate 60 facilitate quick and positive positioning of the system 10 on a failed roller pump 30.

A one-eighth horsepower DC reversible electric motor 16, powered by either AC line current or DC battery, carried by the mounting plate 60 is preferably located for axial alignment in overlying relationship to the rotor 42 of rotor pump **24*a*. Motor 16 is attached by means of mounting connectors 92,94 to the mounting plate 60 with the drive shaft 18 extending through the central perforation 62 in the mounting plate 60. Chuck 20 mounted on the bottom end of the drive shaft 18 allows quick engagement and release of the different types of adapters 12 for various pumps 30. A tachometer 96 is mounted above the motor 16 on a floating plate 98 attached to the upper surface 100 of the motor 16 and operatively connected to motor 16 for measuring the angular speed of motor 16. The entire motor 16 is enclosed in a box-like housing 102 whose upper surface 104 bears the regulation unit 22**.

The regulation unit 22 consists of a digital display 106 connected to tachometer 96 for displaying revolutions per minute of motor 16, a speed control 108 for adjusting the perfusion rate by changing the speed of motor 16, and a direction control 110 for selecting motor rotation direction and stopping motor 16.

In the embodiment 28 of adapter 12 corresponding to pump **24*b* in FIG. 8, connecting shaft 155 is provided which operatively engages rotor 143 by means of a socket 157 complementary to the protruding end of rotor shaft 159. The opposite end 161 of connecting shaft 155 is removably received by chuck 20 for operatively joining drive shaft 18 to adapter 12 during operation of drive system 10. Rotation of shaft 155 in engagement with rotor shaft 159 by motor 16 causes rotor 143 to rotate, moving occlusion rollers 144 along perfusion tubing 46**.

Lower ends 64,65 of mounting rails 58,59 engage upper opposed edges 168 of pump head 170 of pump **24*b* by means of flanged edges 66,67 supporting drive system 10 in operational disposition with pump 24*b***.

The system 10 is normally placed in storage within or nearby the perfusion console 112 during a surgical operation. Rotor adapters 12 appropriate to the particular modular roller pumps 30 installed on the console 112 are stored with the main drive unit. If only one type of modular roller pump 30 is installed on the perfusion console 112, the appropriate adapter 12 is preconnected to drive system 10 by means of chuck 20. During an operation, perfusion is started and maintained by means of the roller pump 30 and the patient's heart and lungs are immobilized for the particular surgical procedure. In the event of a failure of a roller pump 30 during an operation, circulation of the patient's blood through the oxygenator and carbon dioxide remover ceases abruptly and must be resumed within several minutes to avoid widespread systemic damage. Following such a pump failure on a console 112 supplied with auxiliary drive system 10, a perfusion technician quickly removes drive system 10 and the adapter 12 appropriate to the failed pump 30 from their storage location. The technician connects adapter 12 to drive shaft 18 by means of chuck 20. Grasping handles 88,90 the technician then places drive system 10 on the failed pump 30, locating the mounting rails 58,59 on the pump head 70 (170). Connecting drive system 10 to a power source, the technician then starts motor 16 by means of direction control 110 to resume perfusion of the patient's body with oxygenated blood. The entire sequence—removal from storage, connection of adapter 12, placement on failed pump 30, and start-up—requires no more than fifteen seconds. Once perfusion is restored, the technician may adjust and monitor rotor rotation to within the critical range of revolutions per minute by changing motor speed with the speed control 108 and following the change on the tachometer digital display 106.

As may be appreciated, the auxiliary drive system 10 offers almost immediate resumption of perfusion following roller pump failure, precise adjustability, and ease in monitoring perfusion to maximize patient safety in the event of roller pump failure during cardiopulmonary bypass operations.

We claim:

1. For use with a cardiopulmonary perfusion console having an upwardly facing roller pump provided with a central, exposed rotor, an auxiliary power drive system for rotating the rotor of the roller pump during cardiopulmonary bypass operations to assure continued, powered, non-manual operation of the pump for extended periods of time beyond the practical endurance of hand rotation thereof at preselected, critical rates, in the event of failure of the normal pump drive, said auxiliary power drive system comprising:

a base unit;

a reversible electric motor carried by the base unit and provided with a drive shaft extending toward the base unit, said base unit including means engageable with the perfusion console pump and operable to stably support the base unit and the motor thereon in disposition with the motor shaft directly aligned with the rotor, said base unit further including support members having means for complementally engaging failed roller pump and a platform apertured for passage therethrough of said motor drive shaft, said support members being attached to said platform by shiftable means allowing limited transverse movement of said support members with respect to accommodate different sized pumps;

the construction and arrangement of the base unit and motor being such that in the event of a pump failure the base unit and motor may simply be lifted from an adjacent storage position and placed directly on the pump;

an adapter including means for operatively and drivingly engaging said pump rotor when said base unit is operatively placed on the failed pump;

means for operably joining said drive shaft and said adapter and of a length such that the adapter is in proper disposition to drive the pump rotor by mere placement of the base unit and said motor on the failed pump; and means coupled with the motor for permitting selective control of the motor and to effect substantially instantaneous reversal of the direction of rotation thereof.

2. An auxiliary power drive system as set forth in claim 1, and wherein the roller pump rotor has tubing guide pins on opposite sides thereof, said adapter means including a cup-like member inverted in use and having shoulder means thereon for releasably and drivingly engaging the tubing guide pins of said roller pump rotor, said cup member further having a central socket in the normally upper end thereof, there being an elongated connector removably received by said socket, and means for coupling the connector to said motor shaft.

3. An auxiliary power drive system as set forth in claim 1, and wherein the roller pump rotor has a central shaft thereon, said adapter means including a shaft having socket means for receiving and engaging the central shaft of said roller pump rotor, and means for coupling the adapter means to said motor shaft.

* * * * *